US007880580B2

(12) United States Patent
Knobloch et al.

(10) Patent No.: US 7,880,580 B2
(45) Date of Patent: Feb. 1, 2011

(54) THERMISTOR HAVING DOPED AND UNDOPED LAYERS OF MATERIAL

(75) Inventors: Aaron J. Knobloch, Clifton Park, NY (US); Jeffrey B. Fortin, Niskayuna, NY (US); David J. Geer, Johnsonburg, PA (US)

(73) Assignee: General Electric Company, Niskayuna, NY (US)

( * ) Notice: Subject to any disclaimer, the term of this patent is extended or adjusted under 35 U.S.C. 154(b) by 1065 days.

(21) Appl. No.: 11/648,919

(22) Filed: Jan. 3, 2007

(65) Prior Publication Data

US 2007/0126548 A1 Jun. 7, 2007

Related U.S. Application Data

(63) Continuation-in-part of application No. 11/296,139, filed on Dec. 7, 2005.

(51) Int. Cl.
*H01C 7/10* (2006.01)

(52) U.S. Cl. ..... 338/22 R; 29/610.1

(58) Field of Classification Search ..... 338/22 R; 29/610.1, 620

See application file for complete search history.

(56) References Cited

U.S. PATENT DOCUMENTS

| | | | | |
|---|---|---|---|---|
| 4,276,535 | A | 6/1981 | Mitsuyu et al. | |
| 5,119,036 | A * | 6/1992 | Rickards et al. | 324/662 |
| 5,216,404 | A | 6/1993 | Nagai et al. | |
| 5,367,285 | A * | 11/1994 | Swinehart et al. | 338/308 |
| 6,620,696 | B2 * | 9/2003 | Nakamura et al. | 438/300 |
| 7,112,286 | B2 * | 9/2006 | Vialpando et al. | 216/18 |

* cited by examiner

*Primary Examiner*—Kyung Lee
(74) *Attorney, Agent, or Firm*—Joseph J. Christian

(57) ABSTRACT

According to some embodiments, a first layer of doped material may be provided to form a resistor. A second layer of undoped material may then be formed on the first layer. The first layer might comprise, for example, a layer of doped silicon carbide while the second layer comprises a layer of undoped silicon carbide. The resistance of the resistor may then be measured to determine a temperature.

17 Claims, 7 Drawing Sheets

THERMISTOR HAVING DOPED AND UNDOPED LAYERS OF MATERIAL

CROSS-REFERENCE TO RELATED APPLICATION

The present application is a continuation-in-part of U.S. patent application Ser. No. 11/296,139 filed Dec. 7, 2005 and entitled "Method of Making an Ignition Device." The entire contents of that application are incorporated herein by reference.

BACKGROUND

A device may be provided to sense an environment's present temperature. For example, a temperature probe might be used to determine a current operating temperature inside a boiler, a jet engine, or any other industrial system. One such device, referred to as a "thermistor," uses a structure whose resistance varies in a pre-determined manner over a range of temperatures. In this case, a voltage across and/or a current flowing through the structure may be measured to determine the temperature of the structure.

Some thermistors, however, may have impractically small gain characteristics (e.g., the change in resistance may be too small over the range of temperatures that need to be sensed). Moreover, oxidation and other thermal effects may reduce the reliable life of a thermistor when operating at elevated temperatures or limit the operating range of the thermistor. For example, the behavior of the thermistor may begin to drift after prolonged use, especially at relatively high operating temperatures.

Accordingly, it may be desirable to develop a thermistor that has appropriate gain characteristics over a suitable range of temperatures, including substantially high temperatures. It also may be advantageous to develop a thermistor that is robust and reliable and that can be fabricated at a reasonable cost.

SUMMARY

According to some embodiments, a thermistor is associated with a first layer of doped material that is provided to form a resistor. A second layer of undoped material may be formed on the first layer. In some embodiments, a doped layer of material may be encapsulated between two undoped layers.

Some embodiments comprise: means for flowing current through a resistor comprised of a first layer of doped material, wherein a second layer of undoped material is formed on the first layer; and means for determining a temperature based on an electrical characteristic of the first layer of doped material.

Other embodiments comprise: means for forming a first layer of doped material on a substrate to create a resistor; and means for forming a second layer of undoped material on the first layer to protect the resistor.

Other embodiments may provide a thermistor having a patterned layer of doped silicon carbide to form one or more resistors. Another embodiment may provide a thermistor where the resistors are part of a SiC membrane for additional temperature isolation from the substrate.

DETAILED DESCRIPTION

As discussed in detail below, embodiments of the present technique may provide a thermistor having advantageous gain and/or drift characteristics at relatively high temperatures while maintaining reliable operation.

Figure 1:
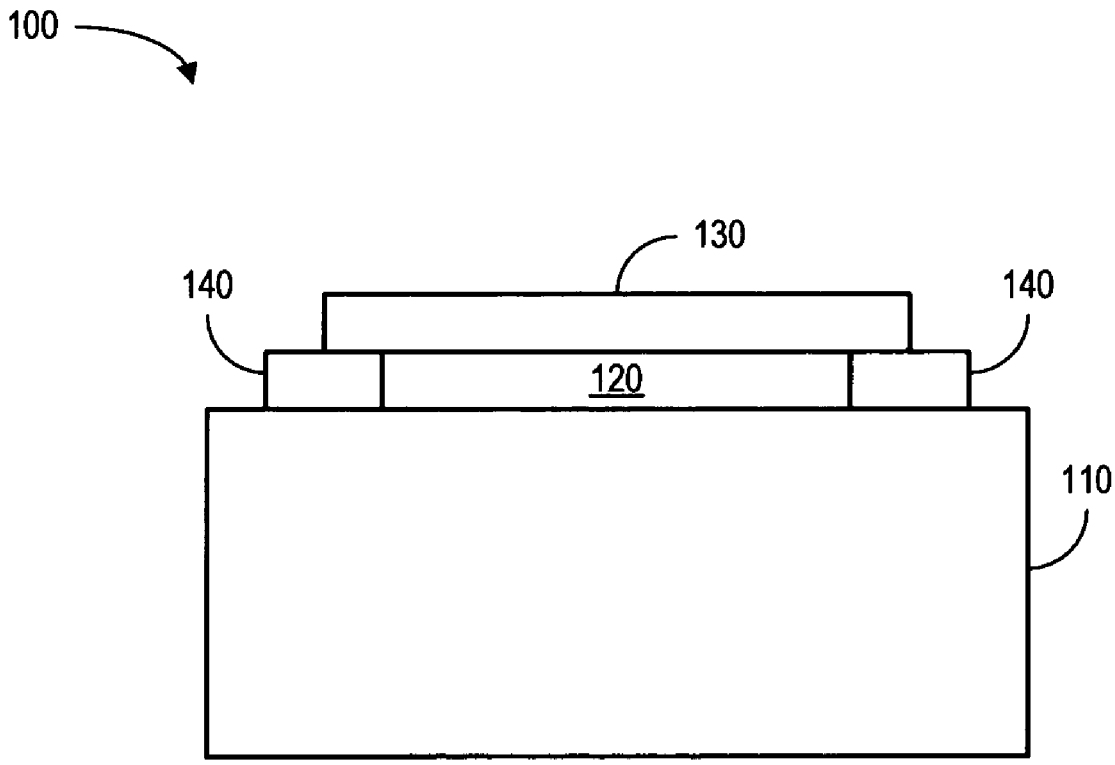
FIG. 1 is a side view of a thermistor in accordance with an exemplary embodiment of the invention.

FIG. 1 is a side view of a thermistor 100 in accordance with an exemplary embodiment of the invention. In particular, a first layer of doped material 120 may be provided on a non-conducting substrate 110 to form a resistor. A second layer of undoped material 130 may be formed on the first layer 120. The second layer 130 may be formed, for example, between the first layer of doped material 120 and an external environment where temperature is to be sensed. According to some embodiments, the thermistor 100 may be within or part of a package (e.g., a thermal probe) and may not be direct contact with the external environment.

According to some embodiments, the first layer 120 comprises doped Silicon Carbide (SiC). Moreover, the SiC of the first layer 120 may be doped via Low Pressure Chemical Vapor Deposition (LPCVD) process (e.g., by doping the first SiC layer 120 in-situ to form a microfabricated resistor). The second layer 130 may comprise, for example, a relatively non-electrically conductive layer of undoped SiC, silicon nitride, silicon dioxide, and/or boron nitride. The second layer 130 may, for example, help passivate and/or prevent oxidation of the first layer 120.

The thermistor 100 may further include two contact pads 140, each contact pad 140 being electrically coupled to a different portion of the first layer 120. The contact pads 140 may be formed using, for example, doped SiC, nickel, gold, carbon such as graphite, platinum, and/or tungsten or alloys composed of combinations of these materials. According to some embodiments, the contact pads 140 are formed in plane with the first doped layer 120.

Figure 2:
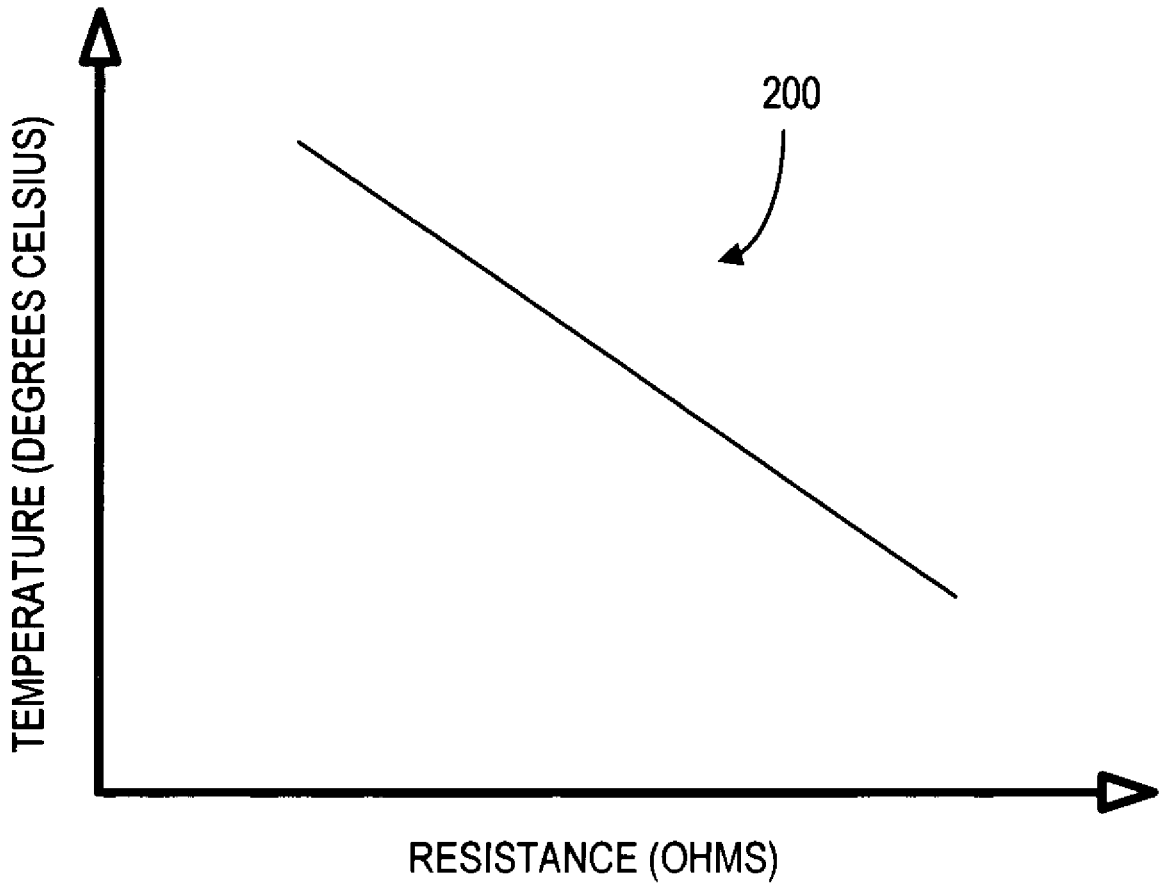
FIG. 2 is a graph illustrating a relationship between resistance and temperature in accordance with an exemplary embodiment of the invention.

The contact pads 140 may be used to access, and measure, the resistance of the first doped layer 120. Note that the resistor formed by the first doped layer 120 may be a Negative Temperature Coefficient (NTC) device. For example, FIG. 2 is a graph 200 illustrating a relationship between resistance and temperature in accordance with an exemplary embodiment of the invention where the resistor is a NTC device. In such a case, the resistance of the resistor will decrease as its temperature increases.

Figure 3:
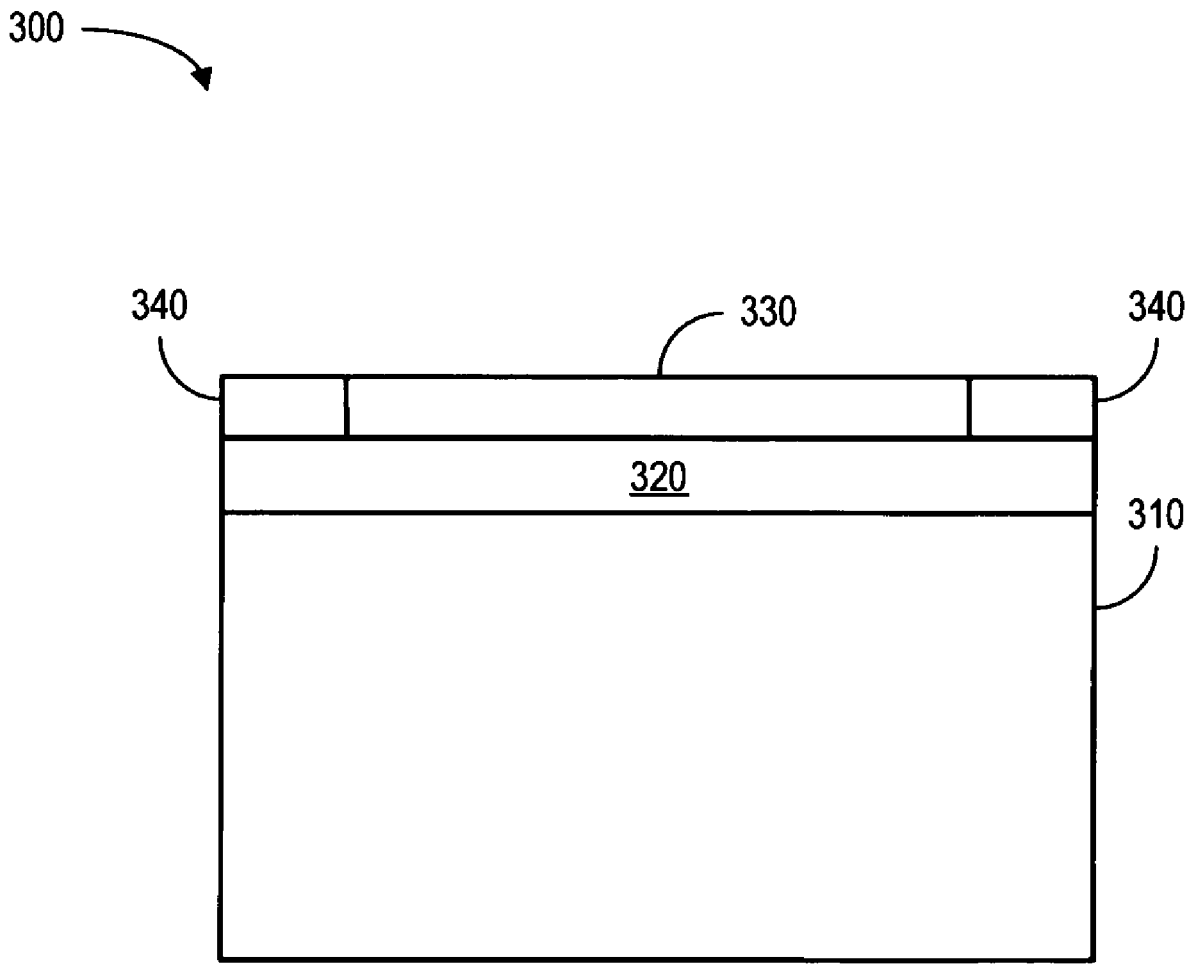
FIG. 3 is a side view of a thermistor in accordance with another exemplary embodiment of the invention.

FIG. 3 is a side view of a thermistor 300 in accordance with another exemplary embodiment of the invention. As before, a first layer of doped material 320 (e.g., of doped SiC) may be provided on a non-conducting substrate 310 to form a resistor. A second layer of undoped material 330 (e.g., a non-electrically conductive layer of undoped SiC) may be formed between the first layer 320 and an external environment where temperature is to be sensed.

The thermistor 300 may further include two contact pads 340, each contact pad 340 being electrically coupled to a different portion of the first layer 320. According to this embodiment, the contact pads 340 are formed in plane with the second doped layer 330 and may be used to access and measure the resistance of the first doped layer 320. Note that in some embodiments, a doped layer of material may be encapsulated between two undoped layers.

Figure 4:
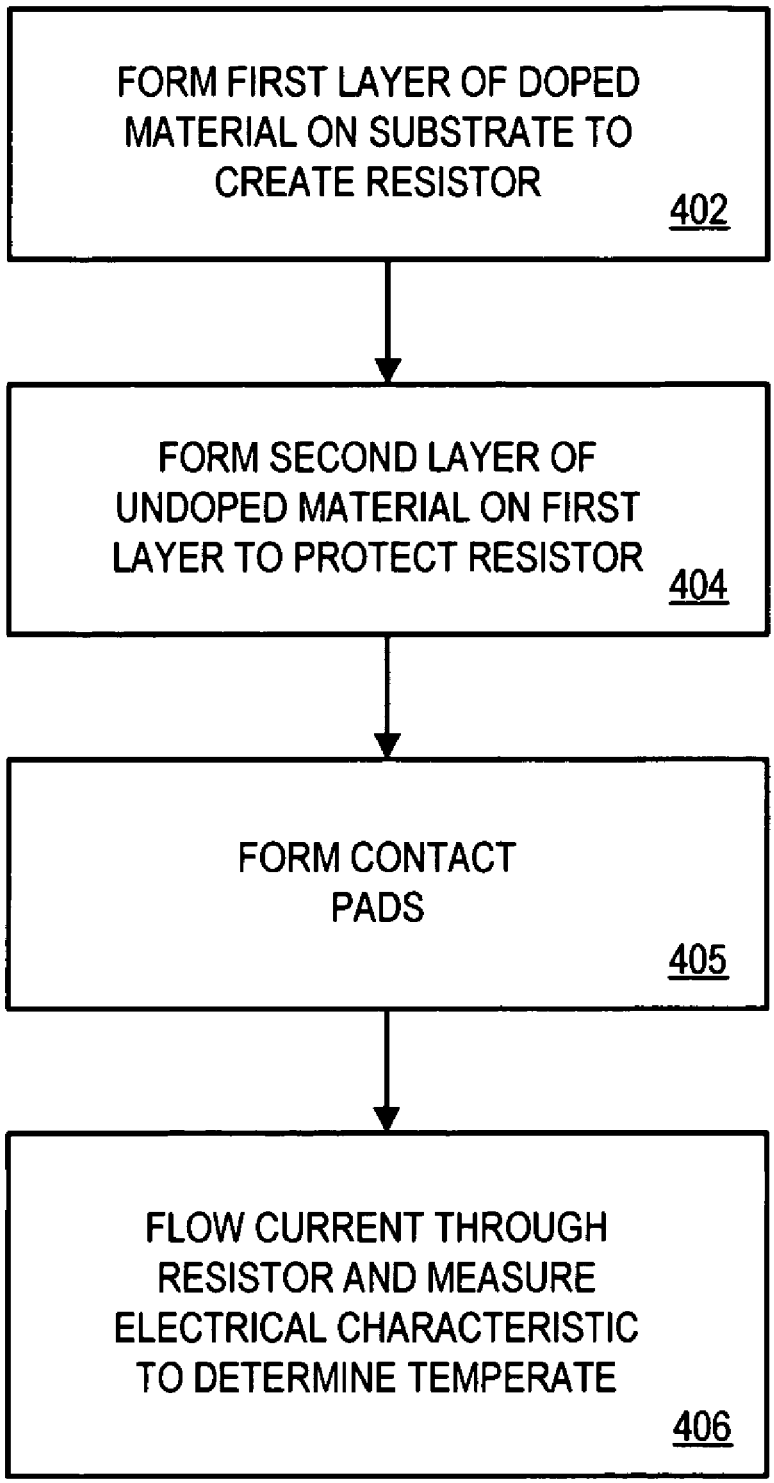
FIG. 4 illustrates a method for creating a thermistor and determining a temperature according to some embodiments.

FIG. 4 illustrates a method that might be used create a thermistor and determine a temperature according to some embodiments. Note that the method may be associated with the thermistors 100, 300 of FIGS. 1 and/or 3. Moreover, the flow chart does not imply a fixed order to the Steps, and the method may be performed in any order that is practical.

At Step 402, a first layer of doped material is formed on a substrate to create a resistor. For example, a first layer of doped poly-SiC might be formed using a LPCVD process to micro-fabricate a resistor. The poly-SiC may be doped by N2 or other suitable dopants in-situ during the LPCVD process. Such an approach may provide relatively good control of the doping and provide a relatively thick resistor. Moreover, micro-fabricating the resistor may allow patterning to achieve a variety of different starting resistances at a relatively low cost.

At Step 404, a second layer of undoped material is formed on the first layer to protect the resistor. The second layer might comprise, for example, a layer of undoped SiC that passivates and/or reduces oxidation of the first layer—even at relatively high temperatures.

At Step 405, the second layer of undoped material is etched to allow the contact of the first layer of doped material at two different locations. This process may be performed using Reactive Ion Etching (RIE) or Inductively Coupled Plasma (ICP) etching. The contact material may be, for example, doped silicon carbide, nickel, gold, conductive carbon, platinum, tungsten, or a combination of these material. These materials may be deposited by sputtering and evaporation.

At Step 406, a current may be flowed through the resistor. For example, a voltage differential may be applied between two contact pads of the resistor. At least one of a current and a voltage associated with the resistor may then be measured to determine an electrical characteristic of the first layer of doped material. Because the resistor is designed to have predetermined NTC characteristics, the temperature of the resistor may be determined based on the measured electrical characteristic (e.g., at a fixed current a measured voltage will indicate a particular resistance and, therefore, a particular temperature associated with that resistance).

Figure 5:
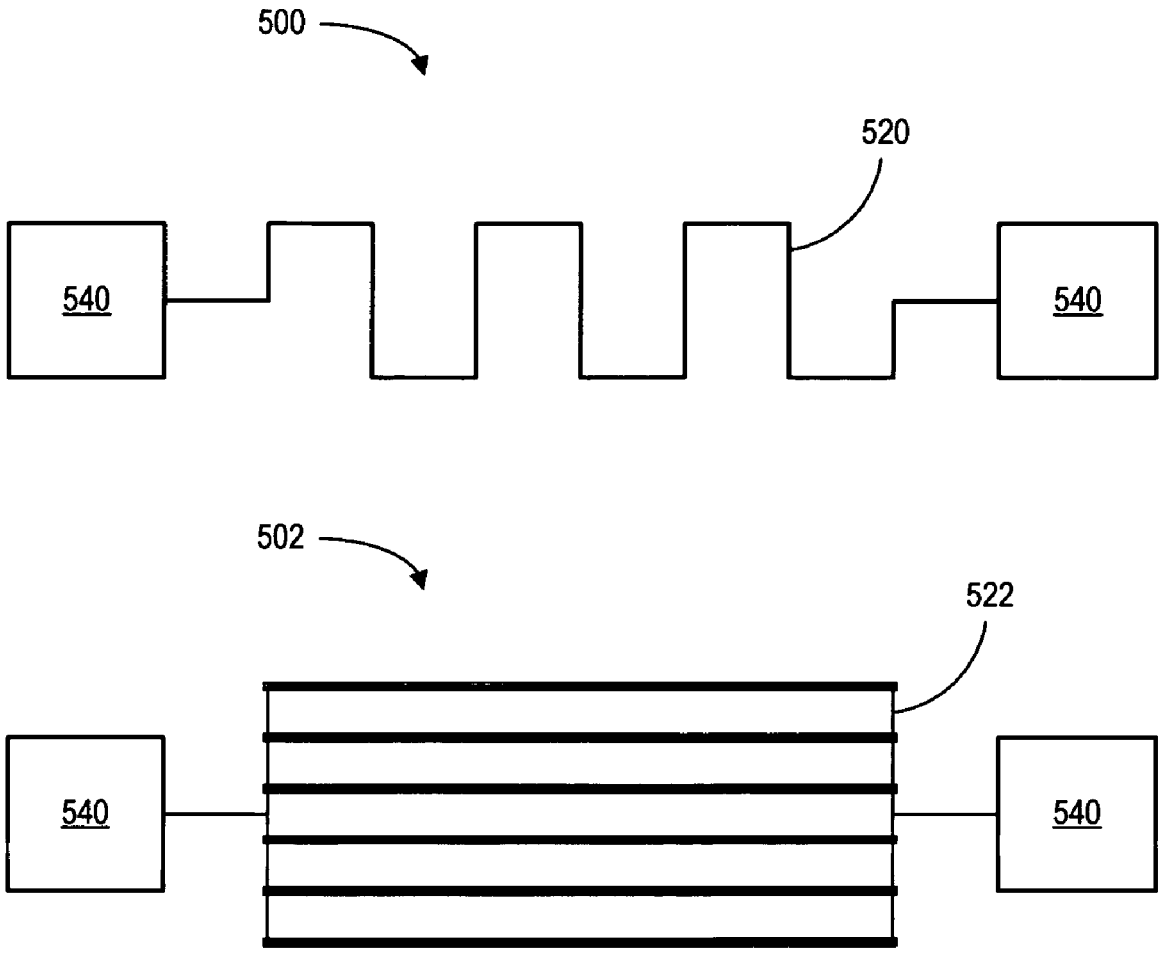
FIG. 5 is a top view of some thermistor geometries in accordance with other exemplary embodiments of the invention.

FIG. 5 is a top view of some thermistor geometries in accordance with other exemplary embodiments of the invention. In either of these embodiment, an insulating layer may be provided on a conducting substrate. Moreover, a first layer of doped material 520, 522 (e.g., of doped SiC) may be provided on the insulating layer to form one or more resistors. The substrate may comprise, for example, a Single-Sided Polished silicon wafer. According to some embodiments, the thickness of such a substrate is about 300 micrometers to about 600 micrometers and the thickness of an insulating layer may be from about 0.5 micrometer to about 3 micrometers.

An insulating layer might include, for example, Si02, LPCVD poly-SiC, silicon nitride and/or undoped SiC. In one embodiment, an insulating layer is grown on a substrate. In certain other embodiments, an insulating layer may be deposited on a substrate via techniques such as Plasma Enhanced Chemical Vapor Deposition (PECVD), Low Temperature Oxide (LTO) and/or High Temperature Oxide (HTO) deposition techniques.

According to the first embodiment 500, the first layer 520 may comprise one or more wires of doped poly-SiC. Moreover, a plurality of resistors may be formed (e.g., to provide a series of microscale resistors). In some embodiments, the resistors include doped silicon carbide. In other embodiments, the resistors may include other conductive high temperature materials such as platinum, titanium, doped polysilicon, or other metals. In the second embodiment 502, the first layer 522 of doped material is formed as a set of parallel microscale wires (e.g., to provide a set of parallel resistors).

Either embodiment 500, 502 may further include two contact pads 540, each contact pad 540 being electrically coupled to a different portion of the first layer 520 to provide electrical connection to the first doped layer 520. The contact pads 540 may be formed, for example, from doped SiC, titanium, tungsten, gold, nickel, carbon such as graphite, and/or combinations thereof.

Either embodiment might also include a protective layer of undoped material (not illustrated in FIG. 5) formed over at least part of the doped first layer 520, 522 (e.g., a layer of undoped SiC).

Figure 6:
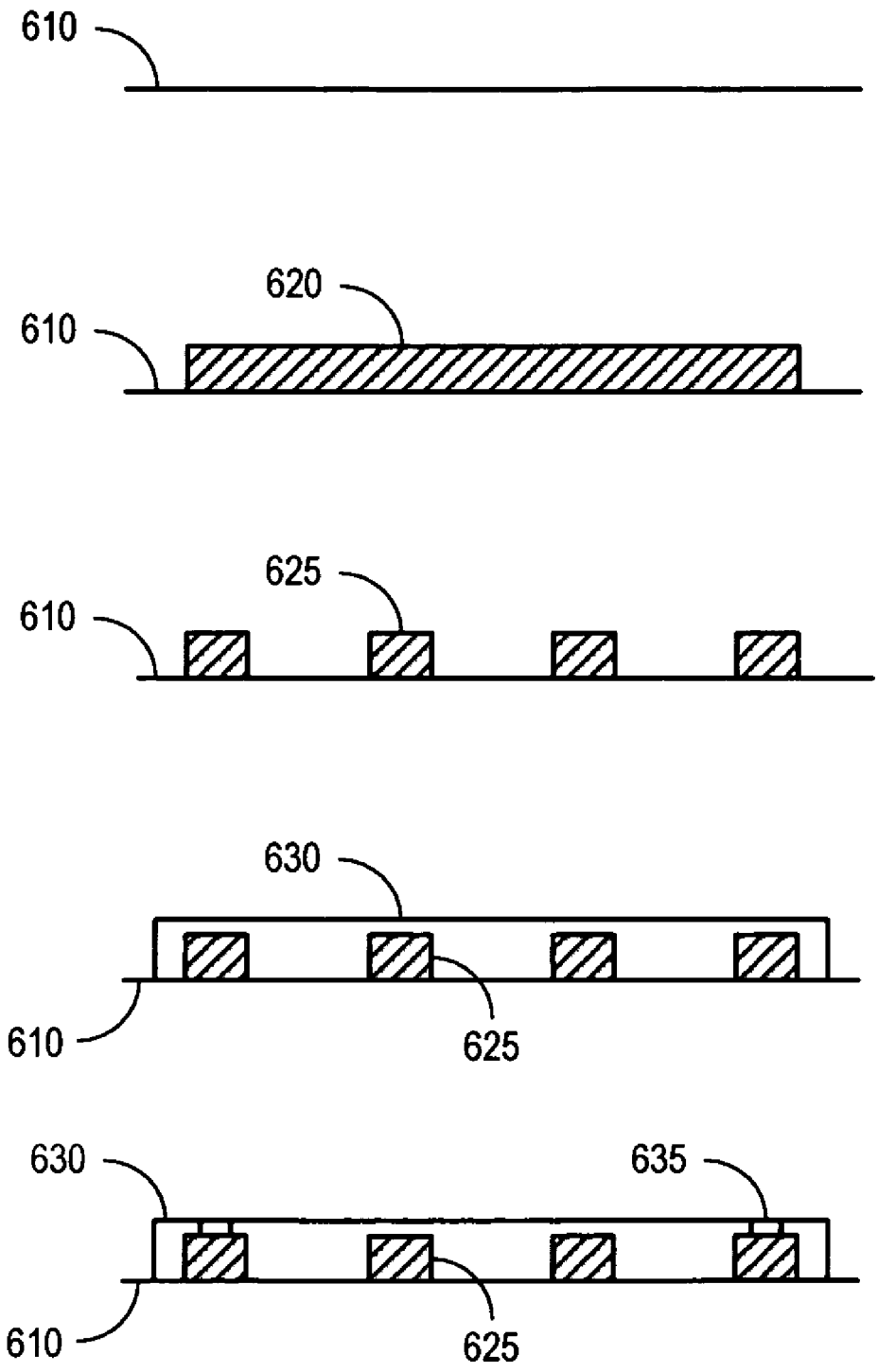
FIG. 6 illustrates steps associated with the creation of thermistor in accordance with some exemplary embodiments of the invention.

FIG. 6 illustrates steps associated with the creation of thermistor in accordance with some exemplary embodiments of the invention. The creation may be associated with, for example, a batch semiconductor fabrication process. Note that various operations may be described as multiple discrete steps performed in a manner that is helpful for understanding embodiments of the invention. However, the order of description should not be construed as to imply that these operations always need be performed in the order they are presented, nor that they are even order dependent.

Initially, a wafer may be provided as a substrate 610. The substrate 610 might include, for example, a p-doped silicon substrate. If the substrate 610 is conductive, an insulating layer (not illustrated in FIG. 6) may be provided on the substrate. Next, a doped layer 620 may be formed on the substrate 610. For example, the doped layer 620 may comprise a layer of doped SiC that is deposited on the substrate 610. The doped layer 620 may then be patterned to form doped poly-SiC microwires 625 on the substrate 610 that function as NTC resistors. Note that the doped poly-SiC microwires 625 might have a thickness of about 0.1-5 micrometers and the resistivity of the doped poly-SiC might be about 0.01 ohm-cm to about 0.2 ohm-cm. Moreover, the doped poly-SiC microwires 625 may be masked via a photoresist masking technique, and subsequently etched via Inductively Coupled Plasma (ICP) etching technique. However, other etching techniques may be employed.

In one embodiment, the microwires 625 are coupled in a series arrangement. Alternatively, the microwires 625 may be coupled in a parallel arrangement. The number of microwires 625 employed in the thermistor may be determined based at least in part upon a resistivity of wire material 625, the geometry of the wires 625, an applied voltage, and/or a desired sensing temperature of the device. In certain embodiments, the microwires 625 include a material having a melting point that is greater than about 1200° C.

Further, a protective layer 630 of undoped poly-SiC may be formed on the microwires 625. In some embodiments, a thickness of the undoped poly-SiC layer 630 is about 1 micrometer to about 5 micrometers. Subsequently, a portion of the undoped poly-SiC layer 630 might be etched to form one or more contact pad holes 635 using photoresist masking and/or ICP etching techniques.

Figure 7:
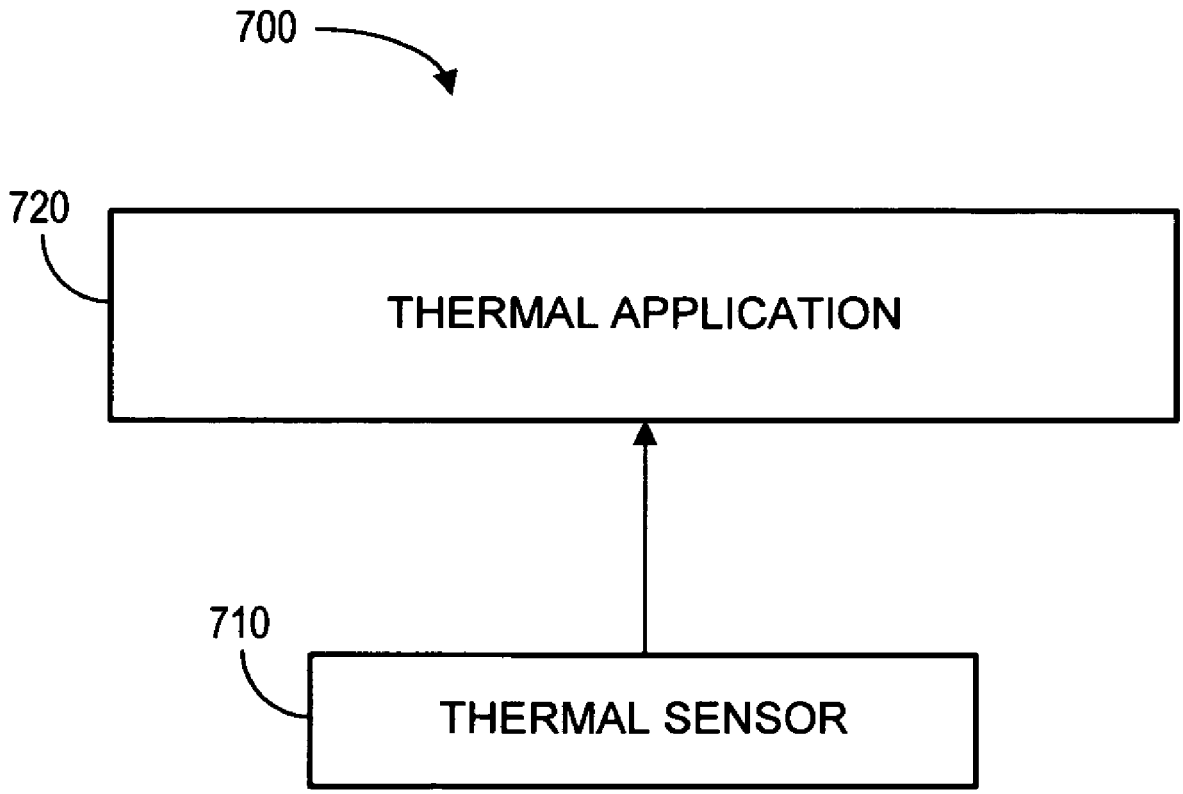
FIG. 7 illustrates a system in accordance with an exemplary embodiment of the invention.

FIG. 7 illustrates a system 700 in accordance with an exemplary embodiment of the invention. The system 700 includes a thermal sensor 710, such as a sensor 710 that includes: (i) a patterned layer of doped SiC forming a series of resistors; and (ii) a protective membrane of undoped SiC formed on the patterned layer of doped SiC, wherein the protective membrane does not thermally isolate the patterned layer of doped SiC. The sensor 710 might be associated with, for example, a temperature probe. The system 700 further includes a thermal application 720 that receives information from the sensor 710. The thermal application 720 might be associated with, for example, a control or measurement device in industrial or commercial settings, such as those used in boilers, water heaters, industrial furnaces, jet engines, and so forth.

As noted above, the design of the thermal sensor 710 may provide a device with appropriate gain and/or drift characteristics, even at relatively high temperatures. Moreover, the sensor 710 may be robust and fabricated at a reasonable cost.

While only certain features of the invention have been illustrated and described herein, many modifications and changes will occur to those skilled in the art. It is, therefore, to be understood that the appended claims are intended to cover all such modifications and changes as fall within the true spirit of the invention. The following illustrates various additional embodiments of the invention. These do not constitute a definition of all possible embodiments, and those skilled in the art will understand that the present invention is applicable to many other embodiments. Further, although the following embodiments are briefly described for clarity, those skilled in the art will understand how to make any changes, if necessary, to the above-described apparatus and methods to accommodate these and other embodiments and applications.

Although a particular layout of micro-wires was provided with respect to FIG. 5, note that any other arrangement and/or geometries may be provided instead. Further, although particular layouts and manufacturing techniques have been described herein, embodiments may be associated with other layouts and/or manufacturing techniques. For example, cap wafers with optical and/or electrical ports may be provided for any of the embodiments described herein. Such wafers may, for example, be used to interface with an Application Specific Integrated Circuit (ASIC) device.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed:

1. A thermistor, comprising:

a first layer of doped material forming a resistor, wherein the first layer comprises wires of doped poly-silicon carbide; and a second layer of undoped material formed on the first layer.

2. The thermistor of claim 1, wherein the second layer is formed between the first layer of doped material and an external environment.

3. The thermistor of claim 1, wherein the doped poly-silicon carbide of the first layer is doped via a low pressure chemical vapor deposition process.

4. The thermistor of claim 3, wherein the doped poly-silicon carbide of the first layer is doped in-situ to form a microfabricated resistor.

5. The thermistor of claim 1, wherein the second layer comprises a non-electrically conductive layer of at least one of: (i) undoped silicon carbide, (ii) silicon nitride, (iii) silicon dioxide or (iv) boron nitride.

6. The thermistor of claim 1, further comprising at least two contact pads, each contact pad being electrically coupled to a different portion of the first layer.

7. The thermistor of claim 6, wherein the contact pads are formed using at least one of: (i) doped silicon carbide, (ii) nickel, (iii) gold, (iv) conductive carbon, (v) platinum, or (vi) tungsten.

8. The thermistor of claim 1, wherein the resistor is associated with a negative temperature coefficient device.

9. The thermistor of claim 1, wherein the second layer is to passivate and/or inhibit oxidation of the first layer.

10. The thermistor of claim 1, wherein the first layer is associated with at least one of (i) a set of resistors connected in series or (ii) a set of resistors connected in parallel.

11. A method, comprising:

flowing current through a resistor comprised of a first layer that comprises wires of doped poly-silicon carbide, wherein a second layer of undoped material is formed on the first layer; and determining a temperature based on an electrical characteristic of the wires of doped poly-silicon carbide.

12. The method of claim 11, further comprising:

measuring at least one of the current and a voltage associated with the resistor to determine the electrical characteristic of the wires of doped poly-silicon carbide.

13. The method of claim 11, wherein the second layer comprises undoped silicon carbide.

14. A method, comprising:

forming wires of doped poly-silicon carbide on a substrate to create a resistor; and forming a layer of undoped material on the wires of doped poly-silicon carbide to protect the resistor.

15. The method of claim 14, wherein the wires of doped poly-silicon carbide are formed via a low pressure chemical vapor deposition process.

16. The method of claim 14, wherein the layer of undoped material comprises a layer of undoped silicon carbide.

17. The method of claim 14, wherein the wires of doped poly-silicon carbide are formed between the layer of undoped material and a second layer of undoped material.

* * * * *

UNITED STATES PATENT AND TRADEMARK OFFICE

CERTIFICATE OF CORRECTION

PATENT NO. : 7,880,580 B2
APPLICATION NO. : 11/648919
DATED : February 1, 2011
INVENTOR(S) : Knobloch et al.

It is certified that error appears in the above-identified patent and that said Letters Patent is hereby corrected as shown below:

Drawing
In Fig. 4, Sheet 4 of 7, in Box "406", in Line 4, delete "TEMPERATE" and insert
-- TEMPERATURE --, therefor.

Signed and Sealed this
Thirteenth Day of September, 2011

David J. Kappos

David J. Kappos
*Director of the United States Patent and Trademark Office*